US009623995B2

(12) United States Patent
Tan

(10) Patent No.: US 9,623,995 B2
(45) **Date of Patent: *Apr. 18, 2017**

(54) CORE PIN BAG DISPENSER

(71) Applicant: Daniel Brian Tan, Harahan, LA (US)

(72) Inventor: Daniel Brian Tan, Harahan, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/465,464

(22) Filed: Aug. 21, 2014

(65) Prior Publication Data

US 2014/0361064 A1 Dec. 11, 2014

Related U.S. Application Data

(62) Division of application No. 13/151,228, filed on Jun. 1, 2011, now Pat. No. 9,085,383.

(51) Int. Cl.
*B65B 61/12* (2006.01)
*B26F 3/02* (2006.01)
(Continued)

(52) U.S. Cl.
CPC ..... *B65B 61/12* (2013.01); *B26F 3/02* (2013.01); *B65B 67/00* (2013.01); *B65H 35/10* (2013.01);
(Continued)

(58) Field of Classification Search
CPC ..... A47F 2009/044; B65H 2701/191; B65H 35/10; B65H 2402/43; Y10T 225/307; Y10T 225/321; Y10T 225/393; Y10T 83/6644; Y10T 83/889; Y10T 83/896; Y10T 83/902; Y10T 83/937;
(Continued)

(56) References Cited

U.S. PATENT DOCUMENTS 496,754 A 5/1893 Streeter
2,211,576 A * 8/1940 Moore ..... A47K 10/38 242/422.5
(Continued)

FOREIGN PATENT DOCUMENTS

KR 20-1985-0000412 Y1 3/1985

OTHER PUBLICATIONS

International search report for corresponding application No. PCT/US2011/042429 mailed Jul. 11, 2012.
(Continued)

*Primary Examiner* — Jonathan Riley
(74) *Attorney, Agent, or Firm* — David A. Belasco; Belasco Jacobs & Townsley, LLP

(57) ABSTRACT

A core pin bag dispenser includes a planar base sized and shaped to fit beneath a roll of film bags. First and second upwardly extending rods are mounted to the base. A retaining pin is sized and shaped to fit slidably within a hollow core of the bag roll. The pin has first and second orthogonal apertures located adjacent the first and second ends that are spaced apart by at least a width of the roll of film bags and are sized and shaped to fit slidably over the first and second upwardly extending rods. An upward pointing snagging hook is mounted adjacent a front edge of the base and is sized and shaped to engage either a chisel cut or a perforation in the bags. Two of the dispensers are mounted to an adapter designed to fit into the side channels of a bin mounted to a vertical surface.

6 Claims, 8 Drawing Sheets

(51) Int. Cl.
*B65H 35/10* (2006.01)
*B65B 67/00* (2006.01)

(52) U.S. Cl.
CPC .... *B65H 2402/43* (2013.01); *B65H 2701/191* (2013.01); *Y10T 225/393* (2015.04)

(58) Field of Classification Search
CPC ..... Y10T 83/949; Y10T 225/239; Y10T 225/241; Y10T 225/255; Y10T 225/30; Y10T 225/247; Y10T 225/232; Y10T 225/246; B65B 61/12; B65B 67/00; B26F 3/02
See application file for complete search history.

(56) References Cited

U.S. PATENT DOCUMENTS 4,071,201 A * 1/1978 Austin, Jr. ..... B65H 16/06 225/46
4,191,317 A 3/1980 Harkins
5,439,521 A 8/1995 Rao
5,495,997 A * 3/1996 Moody ..... A47K 10/38 242/560
5,556,019 A * 9/1996 Morris ..... B65D 33/002 225/106
5,558,262 A 9/1996 Simhaee
5,706,993 A 1/1998 DeMatteis
5,904,316 A 5/1999 Dunning
5,934,535 A 8/1999 Kannankeril
6,234,431 B1 5/2001 Simhaee
6,379,292 B1 4/2002 Simhaee
6,450,380 B1 9/2002 Simhaee
7,104,942 B2 9/2006 Tan
7,195,195 B1 * 3/2007 Pullen, Jr. ..... A47K 10/38 242/598.3
7,591,405 B2 * 9/2009 Daniels ..... B26F 3/02 225/106
2002/0066538 A1 * 6/2002 Lavelle ..... B65H 35/004 156/574
2002/0170937 A1 * 11/2002 Yeh ..... B31B 19/86 225/39
2002/0185513 A1 * 12/2002 Morris ..... B65H 35/10 225/96
2003/0098326 A1 5/2003 Wile
2005/0098600 A1 5/2005 Yeh
2007/0039991 A1 2/2007 Alberts
2007/0262113 A1 11/2007 Dickinson
2011/0073629 A1 3/2011 Tseng
2011/0215128 A1 * 9/2011 Greg ..... B65H 35/00 225/1
2012/0125970 A1 * 5/2012 Tsui ..... A47F 13/085 225/106
2012/0305618 A1 12/2012 Tan

OTHER PUBLICATIONS

International preliminary report on patentability for corresponding application No. PCT/US2011/042429 mailed May 13, 2013.

* cited by examiner

FIG. 9A
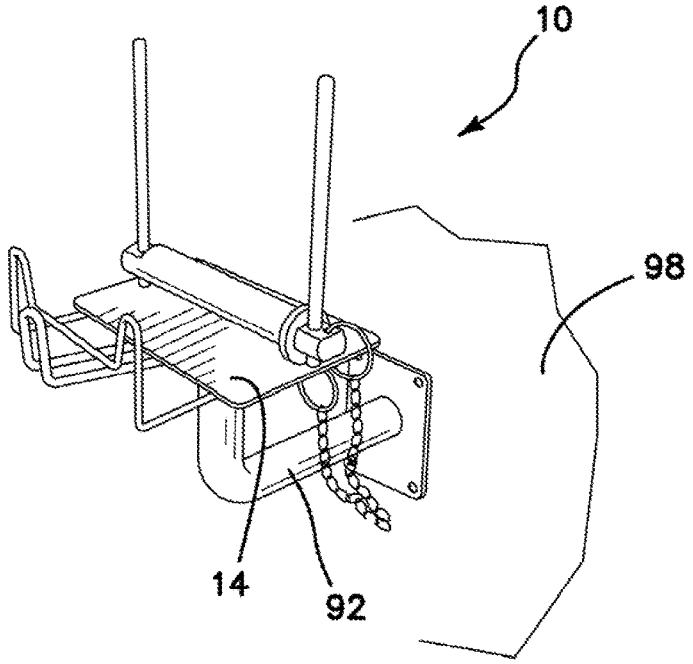
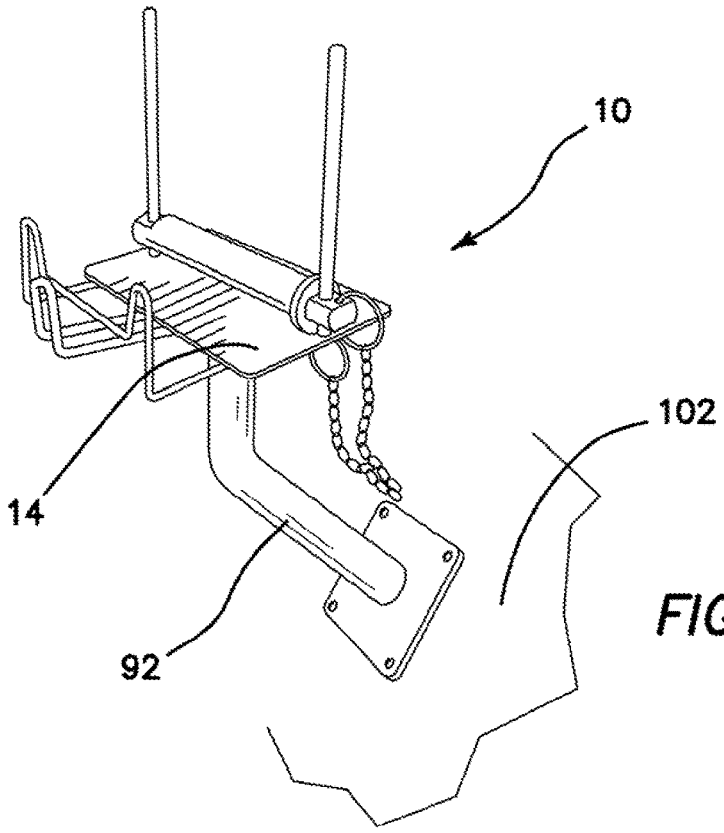
FIG. 9B

CORE PIN BAG DISPENSER

RELATED APPLICATION

The instant application is a divisional application of U.S. Pat. No. 9,085,383 filed Jun. 1, 2011 and incorporates the same by reference in its entirety.

FIELD OF INVENTION

This invention relates to the field of plastic and other film bag storage and dispensing and more specifically to bag dispensers adapted to attach to a horizontal surface or a vertical surface using an existing wall mounted bin.

BACKGROUND OF THE INVENTION

In supermarkets and grocery stores space for the mounting of bag dispensers is usually at a premium. It is desirable to use as much of the space available as possible for the display of produce or the handling of other groceries. However, certain facilities must be provided to the store's customers and checkout personnel for efficient produce sales and merchandise handling. One such facility is the provision of produce bags that may be conveniently used by the customers to collect the produce that they wish to purchase. Another facility is a checkout counter that has a bag dispensing rack mounted into a vertical counter surface, thereby providing unencumbered horizontal counter space for the handling of the customer's merchandise. Ideally, the store would like to provide simple to use produce and merchandise bag dispensers that are easy to maintain, hold a large quantity of bags of a sufficient size and which do not require frequent servicing.

In addition, grocery stores would like to use space for the bag dispensers not readily usable for the display of produce or other merchandise. It is most convenient to display produce and other items on angled or substantially horizontal shelves. Vertical surfaces, such as the walls of display stands and shelves are good locations to position bag dispensers as such surfaces are not readily usable for other displays. Toward this end, some supermarket chains have developed standardized plastic bins that are installed into vertical and some horizontal surfaces. These bins are designed to accommodate a horizontal rod on which a large roll of produce bags is rotatably suspended. The present invention makes use of these standardized bins to make available larger stores of produce or merchandise bags to the shopping customer and checkout personnel.

A number of dispensing devices and produce bags have been designed to efficiently provide produce bags and merchandise bags to shopping customers.

Patent Application No. 2002/0185513, published for Morris is directed to a bag separator and dispenser with a support frame that holds a shaft on which is positioned a roll of bags. The frame holds the shaft above a tapered shelf having a bag stop so that as bags are removed from roll onto the shelf the handles straddle bus stop and the hole between them. Frame has a first arm and an opposing second arm that holds shaft in place to prevent shaft from rotating to holes are formed in shaft that receive first and second arms and. The end of first arm is curved so that when inside of shaft it is coaxial with shaft while the end of second arm is not curved and when inside of shaft it remains perpendicular to the axis of shaft. The roller bag comprises a plurality of bags wound onto a core with an interior diameter that is slightly larger than the exterior diameter of shaft so that as roll rotates freely on core.

U.S. Patent Application No. 2003/0098326, published for Wile illustrates a bag dispensing rack which includes a rod which serves as the axle which fits into a tube of the bag roll. By means of the swinging arm, the rack keeps the roll of bags touching a fixed surface of the rack which provides a friction surface and causes resistance to unrolling as individual bags are removed.

U.S. Patent Application No. 2011/0073629, published for Tseng discloses a plastic grocery bag dispenser with side panels and a guide bar. A swing arm serves as an axle around which a plastic bag roll rotates. A plastic roll stop is located at the free end of the swing arm and adapted to keep the plastic bag roll in place during use. In operation, the plastic bag is pulled down over the rip tongue which causes the plastic bag roll to rotate until perforations in plastic bag pass over the rip tongue allowing bag to separate from the nested plastic bag roll.

U.S. Pat. No. 6,379,292, issued to Simhaee is directed to a continuous roll of plastic bags with separation lines for use in a dispenser mechanism (prior art U.S. Pat. No. 5,558, 262). The plastic bags are provided in a roll of which includes a central axle. The axle rides in a pair of tracks and the film is pulled past a finger in a separating tongue which engages a slot in the center of the perforation line to separate the individual bags from the roll. The axle extends beyond the limits of the plastic bag roll core.

U.S. Patent Application No. 2005/0098600, published for Yeh et al. discloses to a streamline folded T-shirt style produce bag for roll mounting. The folded bags are wound onto a cylindrical core that stands beyond the outside edges of the plastic bags.

It is an objective of the present invention to provide a compact system for dispensing plastic produce bags or merchandise bags that can be removably installed in standardized plastic bins provided by grocery store owners. It is a further objective to provide such a system that can store an increased number of relatively large produce or merchandise bags in the standardized bin. It is a still further objective of the invention to provide a dispenser system that provides a visual indication when the bag roll needs to be replaced. It is yet a further objective to provide such a system that can be easily fabricated from existing dispenser and other mechanical components. Finally, it is an objective of the present invention to provide such a system that is durable, inexpensive and simple to service.

While some of the objectives of the present invention are disclosed in the prior art, none of the inventions found include all of the requirements identified.

SUMMARY OF THE INVENTION

The present invention addresses all of the deficiencies of prior art bag dispenser inventions and satisfies all of the objectives described above.

An adapter for a bin providing the desired features may be constructed from the following components. The adapter includes a support enclosure bin for a roll of film bags. The bin has a half round cylindrical wall, first and second vertical side walls. A supporting rim is provided. The rim is located orthogonally to front edges of the side walls and upper and lower edges of the cylindrical wall and has spaced apertures for mounting the bin to a surface. The surface has an opening sized and shaped to permit passage of outer surfaces of the walls but not the supporting rim. The vertical side walls have first and second integral channels. The channels provide an entry point and support for a rod. The rod is sized and shaped to support the roll of bags in the channels.

The adapter includes a fixture. The fixture includes a planar surface. The surface is sized and shaped to fit at least partially within the bin. At least one bag dispenser for folded roll mounted film bags is provided. The dispenser includes a planar base. The base is sized and shaped to fit beneath a roll of the film bags and is mounted to the fixture. First and second parallel, upwardly extending rods are provided. The rods are mounted to the planar base and have exposed, unattached distal ends. The first and second upwardly extending rods are curved adjacent the distal ends.

A retaining pin is provided. The pin has a first end, a second end, is sized and shaped to fit slidably within a hollow core of the roll of film bags. The pin has first and second orthogonal apertures located adjacent the first and second ends. The first and second orthogonal apertures extend along a diameter of and penetrate completely through the pin. The first and second orthogonal apertures are spaced apart by at least a width of the roll of film bags and are sized and shaped to fit slidably over the first and second upwardly extending rods, respectively, thereby completely surrounding the rods. The penetrating apertures permit the pin to move downwardly as the roll of the bags decreases in diameter, thereby maintaining contact and friction between the roll and the planar base.

An upward pointing snagging hook is provided. The hook is mounted adjacent a front edge of the base and is sized and shaped to engage either of a chisel cut and a perforation in the bags. The retaining pin is introduced into the hollow core of the roll of film bags and located upon the first and second upwardly extending rods with a first bag from the roll extending outwardly beneath the roll and over the snagging hook, thereby providing a dispensing mechanism for the bags. A first axle is provided. The first axle is mounted orthogonally adjacent a first side edge of the fixture. A second axle is provided. The second axle is mounted orthogonally adjacent a second side edge of the fixture. The first axle is mounted coaxially with the second axle. First and second positioning wheels are provided. The positioning wheels are mounted to the first and second axles and located to slidably engage the first and second integral channels with a bottom surface of the fixture located adjacent a lower portion of the cylindrical wall of the bin.

(2) In a variant of the invention, a security link is provided. The link flexibly attaches the retaining pin to the dispenser so as to prevent loss of the pin.

(3) In another variant, the security link is selected from the group that includes chain, wire, string, cord or flexible plastic rod.

(4) In still another variant, the pin further includes a collar. The collar is located adjacent the second end and is sized and shaped to prevent the pin from sliding completely into the core.

(5) In yet another variant, the planar base is attached to a fixture for mounting to a horizontal surface.

(6) In a further variant, the planar base is attached to a fixture for mounting to either a vertical or angled surface.

(7) In still a further variant, a bag stream guide is provided. The bag stream guide is attached adjacent the front edge of the planar base and spaced inwardly from the snagging hook.

(8) In yet a further variant, the planar base further includes at least one aperture for mounting the base to a fixture.

(9) In another variant of the invention, a raised platform is provided. The platform is spaced upwardly from the base and provides clearance for securing at least one fastener through the aperture.

(10) In still another variant, the first and second upwardly extending rods are curved to reduce a height of the dispenser.

(11) An adapter for a bin includes a support enclosure bin for a roll of film bags. The bin has a half round cylindrical wall, first and second vertical side walls. A supporting rim is provided. The rim is located orthogonally to front edges of the side walls and upper and lower edges of the cylindrical wall and has spaced apertures for mounting the bin to a surface. The surface has an opening sized and shaped to permit passage of outer surfaces of the walls but not the supporting rim. The vertical side walls have first and second integral channels. The channels provide an entry point and support for a rod. The rod is sized and shaped to support the roll of bags in the channels.

The adapter includes first and second bag dispensers for vertically folded roll mounted film bags. Each of the dispensers has a planar base. The base is sized and shaped to fit beneath a roll of the film bags and is mounted to a fixture. The fixture includes a planar surface. The surface is sized and shaped to fit at least partially within the bin. A first axle is provided. The first axle is mounted orthogonally adjacent a first side edge of the fixture. A second axle is provided. The second axle is mounted orthogonally adjacent a second side edge of the fixture. The first axle is mounted coaxially with the second axle. First and second positioning wheels are provided. The positioning wheels are mounted to the first and second axles and located to slidably engage the first and second integral channels with a bottom surface of the fixture located adjacent a lower portion of the cylindrical wall of the bin.

(12) In a variant of the invention, the dispensers further include at least one aperture penetrating the planar base for mounting the base to the fixture and a raised platform. The platform is spaced upwardly from the base and provides clearance for securing at least one fastener through the aperture.

(13) In another variant, the dispensers further include first and second parallel, upwardly extending rods. The rods are mounted to the planar base. A retaining pin is provided. The pin has a first end, a second end, is sized and shaped to fit slidably within a hollow core of the roll of film bags. The pin has first and second orthogonal apertures located adjacent the first and second ends. The first and second orthogonal apertures are spaced apart by at least a width of the roll of film bags and are sized and shaped to fit slidably over the first and second upwardly extending rods, respectively. An upward pointing snagging hook is provided. The hook is mounted adjacent a front edge of the base and is sized and shaped to engage either a chisel cut or a perforation in the bags. The retaining pin is introduced into the hollow core of the roll of film bags and located upon the first and second upwardly extending rods with a first bag from the roll extending outwardly beneath the roll and over the snagging hook, thereby providing a dispensing mechanism for the bags.

(14) In still another variant, the dispensers further include a security link. The link flexibly attaches the retaining pin to the dispenser so as to prevent loss of the pin.

(15) In yet another variant, the security link is selected from the group that includes chain, wire, string, cord or flexible plastic rod.

(16) In a further variant, the pin further includes a collar. The collar is located adjacent the second end and is sized and shaped to prevent the pin from sliding completely into the core.

(17) In still a further variant, the dispensers further include a bag stream guide. The bag stream guide is attached adjacent the front edge of the planar base and spaced inwardly from the snagging hook.

(18) In yet a further variant, the first and second upwardly extending rods are curved to reduce a height of the dispenser.

(19) In another variant of the invention, a bracket is provided. The bracket is sized and shaped to secure the adapter to the bin.

(20) In a final variant, the bracket is an angled, rigid member sized and shaped to bear upon an upper surface of the fixture.

An appreciation of the other aims and objectives of the present invention and an understanding of it may be achieved by referring to the accompanying drawings and the detailed description of a preferred embodiment.

DESCRIPTION OF THE DRAWINGS

FIG. 9A is a perspective view of an alternative embodiment of the dispenser mounted to a fixture attached to a vertical surface; and FIG. 9B is a perspective view of an alternative embodiment of the dispenser mounted to a fixture attached to an angled surface.

DETAILED DESCRIPTION OF THE PREFERRED EMBODIMENT (1) FIGS. 1-9 illustrate a core pin bag dispenser 10 providing the desired features that may be constructed from the following components. As illustrated in FIGS. 1, 2, 6, 9 and 10, planar base 14 is provided. The base 14 is sized and shaped to fit beneath a roll 18 of film bags 22. First 26 and second 30 upwardly extending rods are provided. The rods 26, 30 are mounted to the planar base 14. A retaining pin 34 is provided. The pin 34 has a first end 38, a second end 42, is sized and shaped to fit slidably within a hollow core 46 of the roll 18 of film bags 22. The pin 34 has first 50 and second 54 orthogonal apertures located adjacent the first 38 and second 42 ends. The first 50 and second 54 orthogonal apertures are spaced apart by at least a width 58 of the roll 18 of film bags 22 and are sized and shaped to fit slidably over the first 26 and second 30 upwardly extending rods, respectively.

An upward pointing snagging hook 62 is provided. The hook 62 is mounted adjacent a front edge 66 of the base 14 and is sized and shaped to engage either a chisel cut 70 or a perforation 74 in the bags 22, as illustrated in FIGS. 7 and 8. As illustrated in FIGS. 1, 2, 6, 9 and 10, the retaining pin 34 is introduced into the hollow core 46 of the roll 18 of film bags 22 and located upon the first 26 and second 30 upwardly extending rods with a first bag 22 from the roll 18 extending outwardly beneath the roll 18 and over the snagging hook 62, thereby providing a dispensing mechanism 10 for the bags 22.

Figure 1:
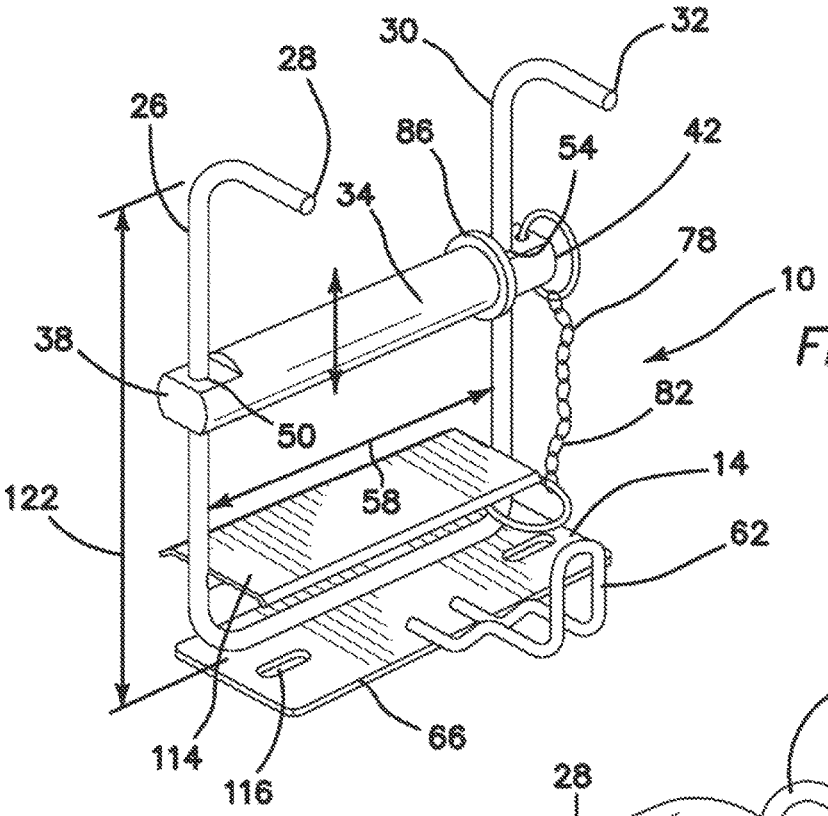
FIG. 1 is a perspective view of the preferred embodiment of the dispenser of the invention.
Figure 2:
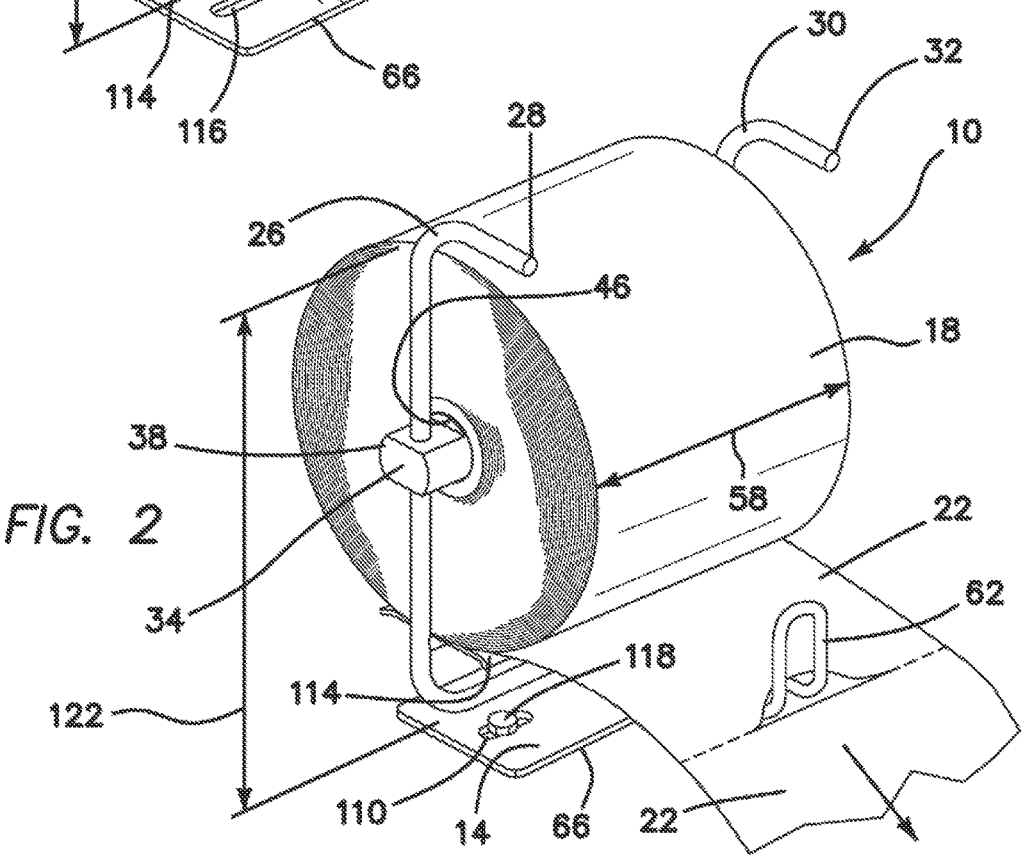
FIG. 2 is a perspective view of the FIG. 1 embodiment with a bag roll installed.

(2) In a variant of the invention, a security link 78 is provided. The link 78 flexibly attaches the retaining pin 34 to the dispenser 10 so as to prevent loss of the pin 34.

(3) In another variant, the security link 78 is selected from the group that includes chain 82, wire (not shown), string (not shown), cord (not shown) or flexible plastic rod (not shown).

(4) In still another variant, the pin 34 further includes a collar 86. The collar 86 is located adjacent the second end 42 and is sized and shaped to prevent the pin 34 from sliding completely into the core 46.

Figure 6:
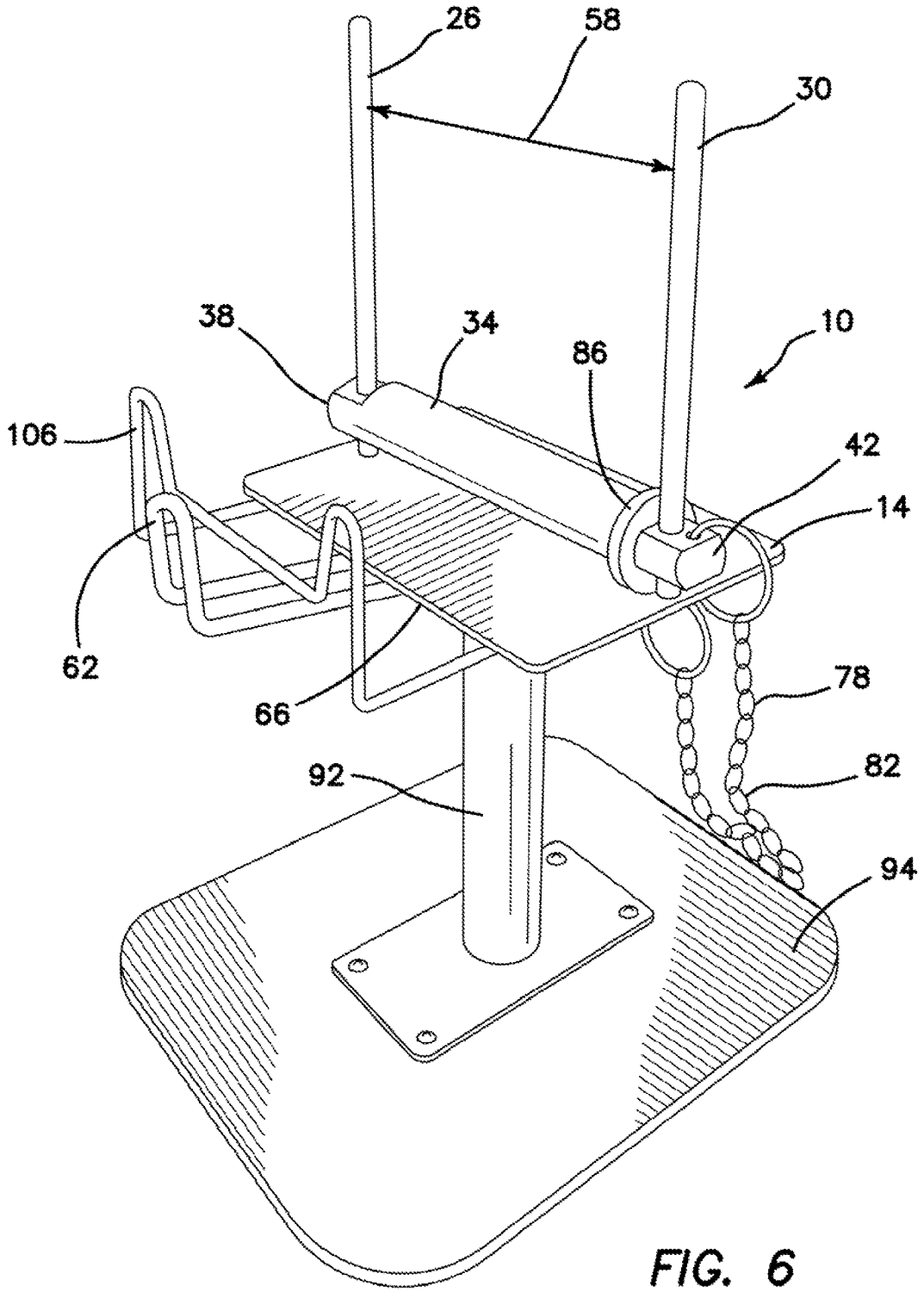
FIG. 6 is a perspective view of an alternative embodiment of the dispenser mounted to a fixture attached to a horizontal surface.

(5) In yet another variant, as illustrated in FIG. 6, the planar base 14 is attached to a fixture 92 for mounting to a horizontal surface 94.

(6) In a further variant, as illustrated in FIGS. 9A and 9B, the planar base 14 is attached to a fixture 92 for mounting to either a vertical 98 or angled surface 102.

(7) In still a further variant, a bag stream guide 106 is provided. The bag stream guide 106 is attached adjacent the front edge 66 of the planar base 14 and spaced inwardly from the snagging hook 62.

(8) In yet a further variant, the planar base 14 further includes at least one aperture 110 for mounting the base 14 to a fixture 92.

(9) In another variant of the invention, as illustrated in FIGS. 1-4, a raised platform 114 is provided. The platform 114 is spaced upwardly from the base 14 and provides clearance for securing at least one fastener 118 through the aperture 110.

(10) In still another variant, the first 26 and second 30 upwardly extending rods are curved to reduce a height 122 of the dispenser 10.

Figure 3:
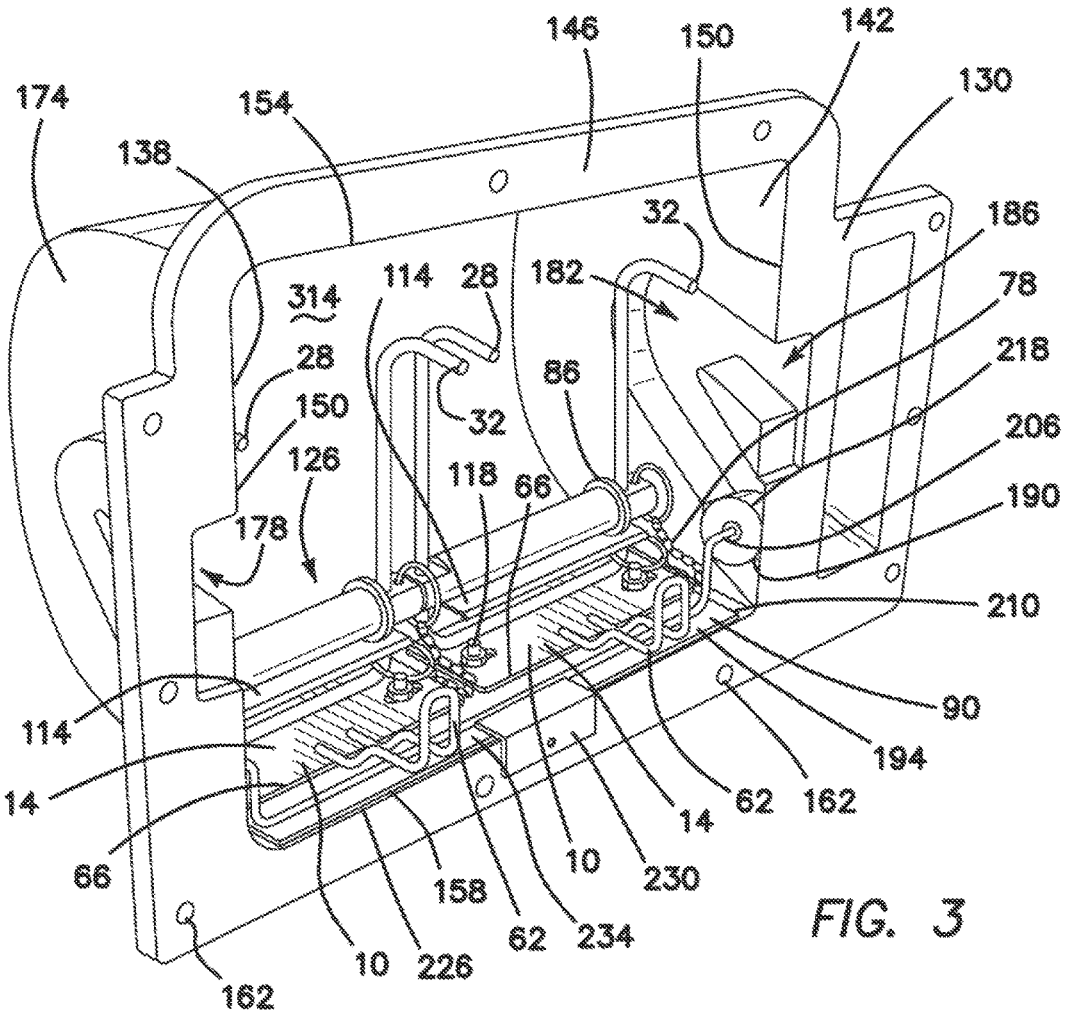
FIG. 3 is a perspective view of two of the dispensers of the FIG. 1 embodiment attached to an adapter and installed in a bin.
Figure 4:
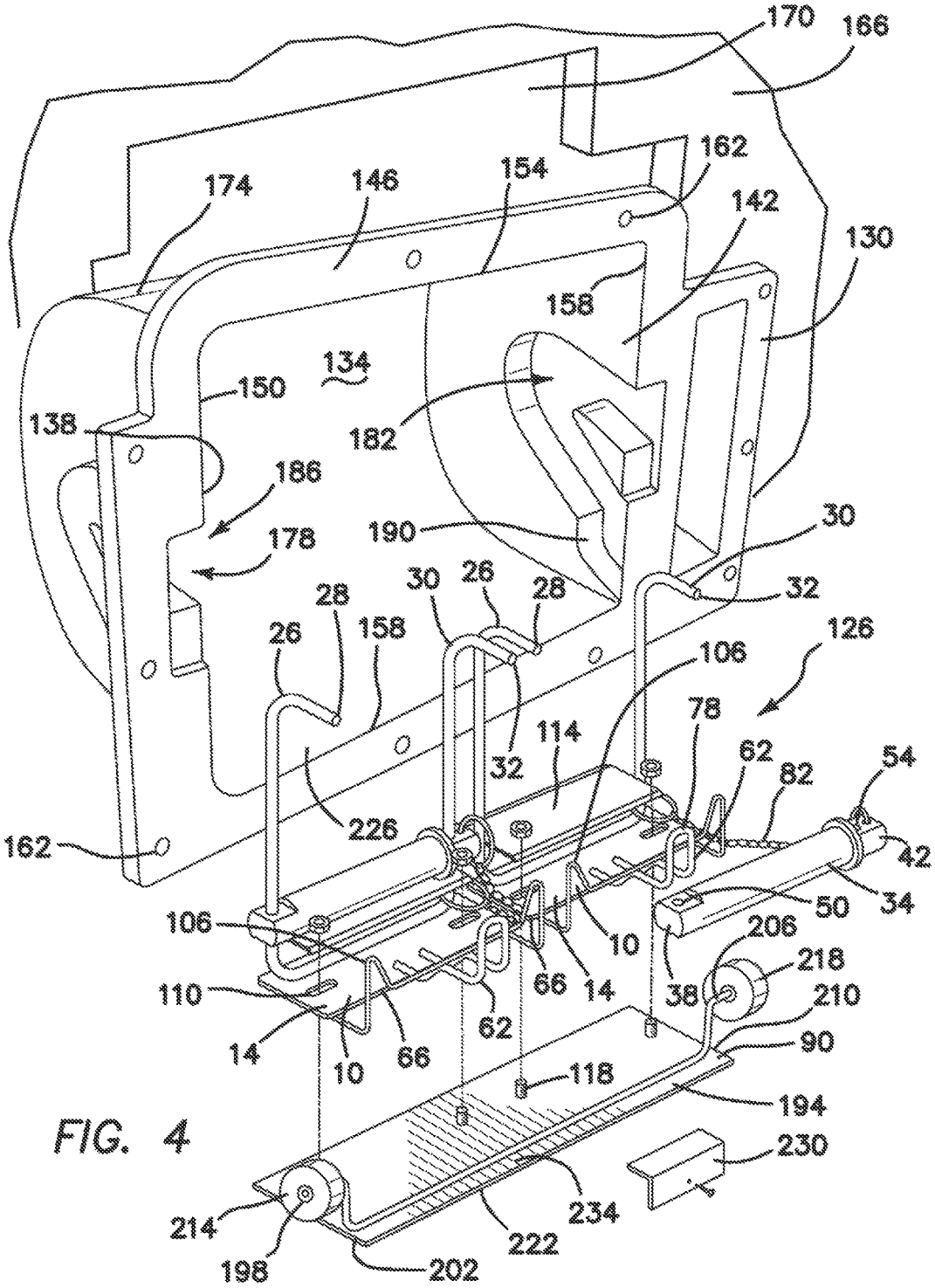
FIG. 4 is a perspective view of an exploded view of the FIG. 4 embodiment with the addition of bag stream guides.
Figure 5A:
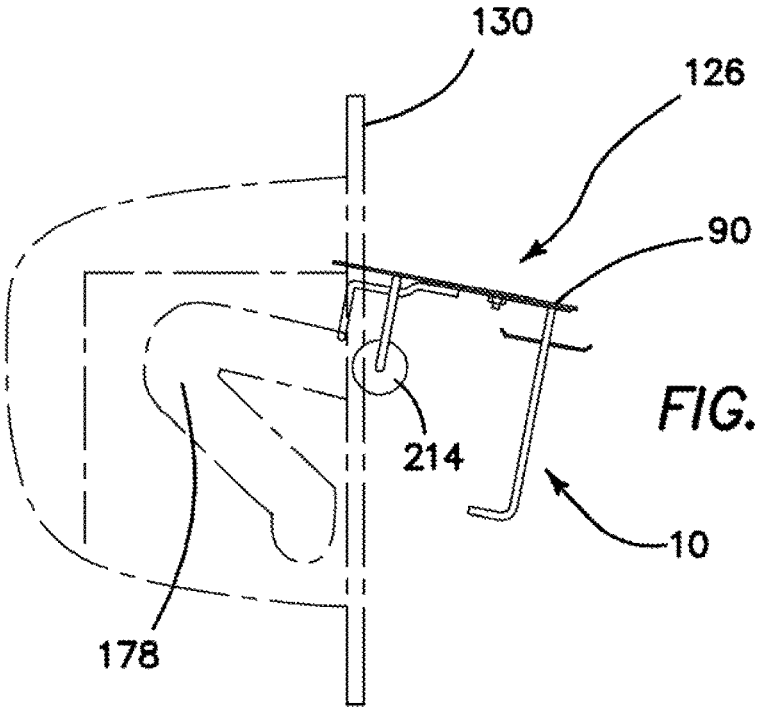
FIGS. 5A-5D are side elevational views of the process of installing the adapter with attached dispensers into a bin.
Figure 5B:
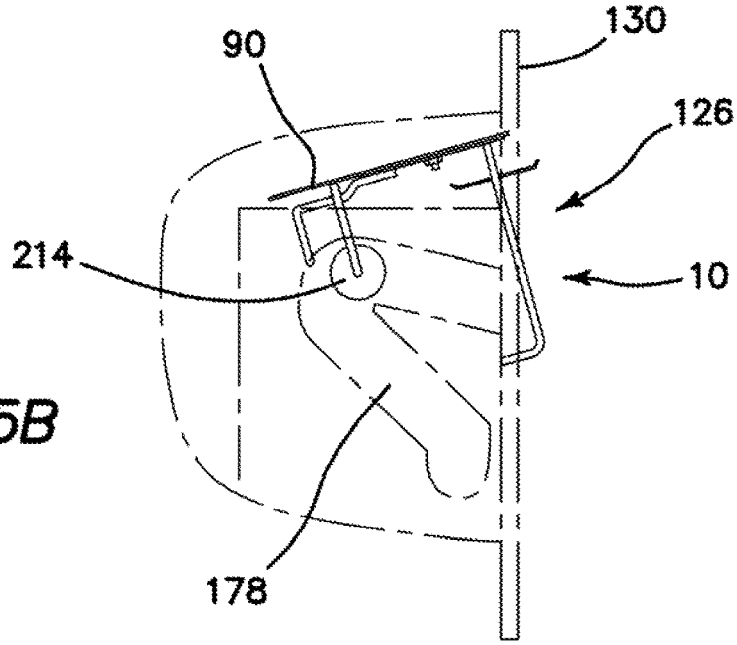
Figure 5C:
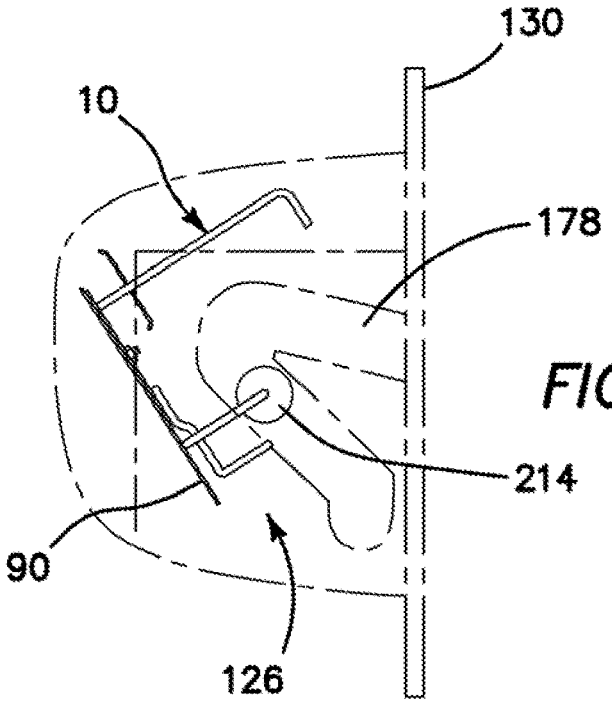
Figure 5D:
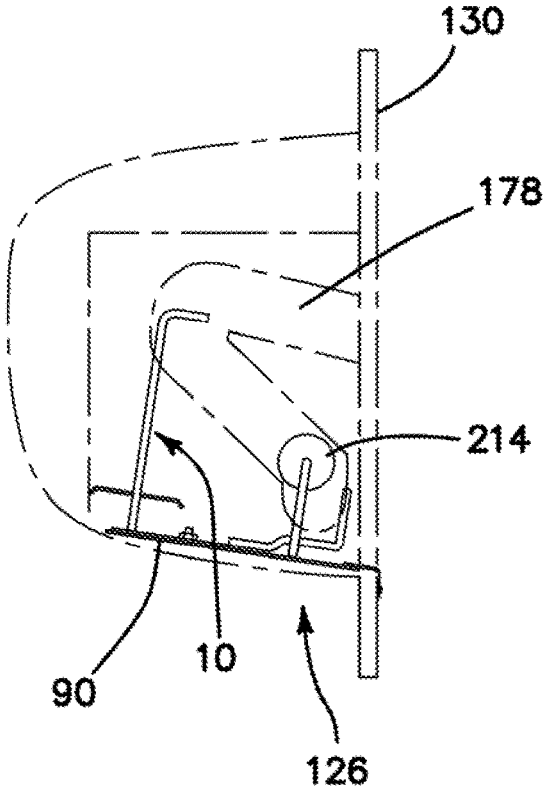

As illustrated in FIGS. 3-5, an adapter for a bin 126 providing the desired features may be constructed from the following components. The adapter 126 includes a support enclosure bin 130 for a roll 18 of film bags 22. The bin 130 has a half round cylindrical wall 134, first 138 and second 142 vertical side walls. A supporting rim 146 is provided. The rim 146 is located orthogonally to front edges 150 of the side walls 138, 142 and upper 154 and lower 158 edges of the cylindrical wall 134 and has spaced apertures 162 for mounting the bin 130 to a surface 166. The surface 166 has an opening 170 sized and shaped to permit passage of outer surfaces 174 of the walls 134, 138, 142 but not the supporting rim 146. The vertical side walls 138, 142 have first 178 and second 182 integral channels. The channels 178, 182 provide an entry point 186 and support 190 for a rod (not shown). The rod is sized and shaped to support the roll 18 of bags 22 in the channels 178, 182.

The adapter 126 includes a fixture 90. The fixture 90 includes a planar surface 194. The surface 194 is sized and shaped to fit at least partially within the bin 130. At least one bag dispenser 10 for folded roll mounted film bags 22 is provided. The dispenser 10 includes a planar base 14. The base 14 is sized and shaped to fit beneath a roll 18 of the film bags 22 and is mounted to the fixture 90. First 26 and second 30 parallel, upwardly extending rods are provided. The rods 26, 30 are mounted to the planar base 14 and have exposed, unattached distal ends 28, 32. The first 26 and second 30 upwardly extending rods are curved adjacent the distal ends 28, 32.

A retaining pin 34 is provided. The pin 34 has a first end 38, a second end 42, is sized and shaped to fit slidably within a hollow core 46 of the roll 18 of film bags 22. The pin 34 has first 50 and second 54 orthogonal apertures located adjacent the first 38 and second 42 ends. The first 50 and second 54 orthogonal apertures extend along a diameter of and penetrate completely through the pin 34. The first 50 and second 54 orthogonal apertures are spaced apart by at least a width 58 of the roll 18 of film bags 22 and are sized and shaped to fit slidably over the first 26 and second 30 upwardly extending rods, respectively, thereby completely surrounding the rods 26, 30. The penetrating apertures 50, 54 permit the pin to move downwardly as the roll 18 of the bans 22 decreases in diameter, thereby maintaining contact and friction between the roll 18 and the planar base 14.

Figure 7:
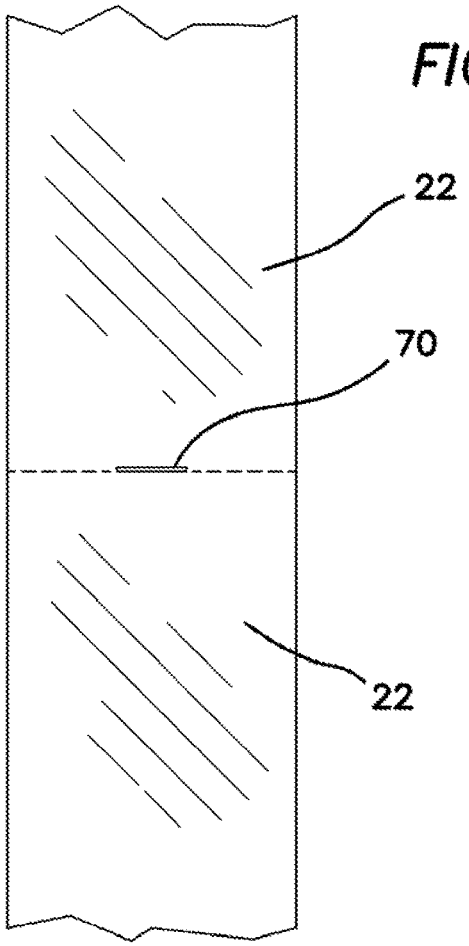
FIG. 7 is a plan view of roll mounted bags having a chisel cut.
Figure 8:
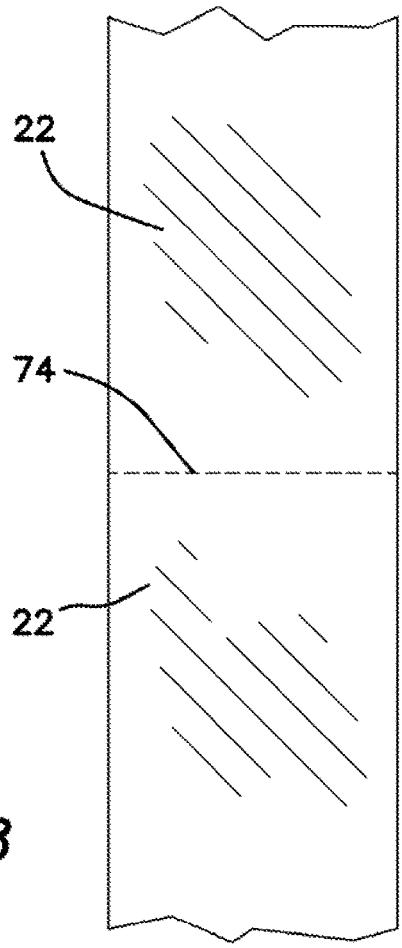
FIG. 8 is a plan view of roll mounted bags having a perforation joining the bags.

An upward pointing snagging hook 62 is provided. The hook 62 is mounted adjacent a front edge 66 of the base 14 and is sized and shaped to engage either of a chisel cut 70 and a perforation 74 in the bags 22 as illustrated in FIGS. 7 and 8. As illustrated in FIGS. 3 and 4, the retaining pin 34 is introduced into the hollow core 46 of the roll 18 of film bags 22 and located upon the first 26 and second 30 upwardly extending rods with a first bag 22 from the roll 18 extending outwardly beneath the roll 18 and over the snagging hook 62, thereby providing a dispensing mechanism 10 for the bags 22. A first axle 198 is provided. The first axle 198 is mounted orthogonally adjacent a first side edge 202 of the fixture 90. A second axle 206 is provided. The second axle 206 is mounted orthogonally adjacent a second side edge 210 of the fixture 90. The first axle 198 is mounted coaxially with the second axle 206. First 214 and second 218 positioning wheels are provided. The positioning wheels 214, 218 are mounted to the first 198 and second 206 axles and located to slidably engage the first 178 and second 182 integral channels with a bottom surface 222 of the fixture 90 located adjacent a lower portion 226 of the cylindrical wall 134 of the bin 130.

The adapter includes first 10 and second 10 bag dispensers for vertically folded roll mounted film bags 22. Each of the dispensers 10 has a planar base 14. The base 14 is sized and shaped to fit beneath a roll 18 of the film bags 22 and is mounted to a fixture 90. The fixture 90 includes a planar surface 194. The surface 194 is sized and shaped to fit at least partially within the bin 130. A first axle 198 is provided. The first axle 198 is mounted orthogonally adjacent a first side edge 202 of the fixture 90. A second axle 206 is provided. The second axle 206 is mounted orthogonally adjacent a second side edge 210 of the fixture 90. The first axle 198 is mounted coaxially with the second axle 206. First 214 and second 218 positioning wheels are provided. The positioning wheels 214, 218 are mounted to the first 198 and second 206 axles and located to slidably engage the first 178 and second 182 integral channels with a bottom surface 222 of the fixture 90 located adjacent a lower portion 226 of the cylindrical wall 134 of the bin 130.

(12) In a variant of the invention, the dispensers 10 further include at least one aperture 110 penetrating the planar base 14 for mounting the base 14 to the fixture 90 and a raised platform 114. The platform 114 is spaced upwardly from the base 14 and provides clearance for securing at least one fastener 118 through the aperture 110.

(13) In another variant, the dispensers further include First 26 and second 30 upwardly extending rods are provided. The rods 26, 30 are mounted to the planar base 14. A retaining pin 34 is provided. The pin 34 has a first end 38, a second end 42, is sized and shaped to fit slidably within a hollow core 46 of the roll 18 of film bags 22. The pin 34 has first 50 and second 54 orthogonal apertures located adjacent the first 38 and second 42 ends. The first 50 and second 54 orthogonal apertures are spaced apart by at least a width 58 of the roll 18 of film bags 22 and are sized and shaped to fit slidably over the first 26 and second 30 upwardly extending rods, respectively.

An upward pointing snagging hook 62 is provided. The hook 62 is mounted adjacent a front edge 66 of the base 14 and is sized and shaped to engage either a chisel cut 70 or a perforation 74 in the bags 22, as illustrated in FIGS. 7 and 8. As illustrated in FIGS. 3 and 4, the retaining pin 34 is introduced into the hollow core 46 of the roll 18 of film bags 22 and located upon the first 26 and second 30 upwardly extending rods with a first bag 22 from the roll 18 extending outwardly beneath the roll 18 and over the snagging hook 62, thereby providing a dispensing mechanism 10 for the bags 22

(14) In still another variant, the dispensers further include a security link 78. The link 78 flexibly attaches the retaining pin 34 to the dispenser 10 so as to prevent loss of the pin 34.

(15) In yet another variant, the security link 78 is selected from the group that includes chain 82, wire (not shown), string (not shown), cord (not shown) or flexible plastic rod (not shown).

(16) In a further variant, the pin 34 further includes a collar 86. The collar 86 is located adjacent the second end 42 and is sized and shaped to prevent the pin 34 from sliding completely into the core 46.

(17) In still a further variant, the dispensers further include a bag stream guide 106. The bag stream guide 106 is attached adjacent the front edge 66 of the planar base 14 and spaced inwardly from the snagging hook 62.

(18) In yet a further variant, the first 26 and second 30 upwardly extending rods are curved to reduce a height 122 of the dispenser 10.

(19) In another variant of the invention, a bracket 230 is provided. The bracket 230 is sized and shaped to secure the adapter 126 to the bin 130.

(20) In a final variant, the bracket 230 is an angled, rigid member sized and shaped to bear upon an upper surface 234 of the fixture 90.

The core pin bag dispenser 10 and adapter for a bin 126 have been described with reference to particular embodiments. Other modifications and enhancements can be made without departing from the spirit and scope of the claims that follow.

The invention claimed is:

1. A dispenser for roll mounted film bags, comprising:

a planar base, said base being sized and shaped to fit beneath a roll of film bags;

said planar base comprises at least one aperture for mounting said base to a fixture;

a raised platform, said platform being spaced upwardly from said planar base, forming a gap between said planar base and said raised platform and providing clearance above said planar base for securing at least one fastener through said aperture;

first and second parallel, upwardly extending rods, said rods being mounted to said planar base and having exposed, unattached distal ends;

said first and second parallel, upwardly extending rods being curved adjacent said unattached distal ends;

a retaining pin, said pin having a first end, a second end, being sized and shaped to fit slidably within a hollow core of said roll of film bags and having first and second orthogonal apertures disposed adjacent said first and second ends, said first and second orthogonal apertures extending along a diameter of and penetrating completely through said pin;

said first and second orthogonal apertures being spaced apart by at least a width of said roll of film bags and being sized and shaped to fit slidably over said first and second upwardly extending rods, respectively and completely surrounding said rods;

said first and second orthogonal apertures permitting said pin to move downwardly as said roll of said bags decreases in diameter, thereby maintaining constant contact and friction between said roll and said raised platform as each bag is dispensed from said bag roll and said bag roll decreases in diameter;

a security link, said link flexibly attaching said retaining pin to said dispenser so as to prevent loss of said pin;

an upward pointing snagging hook, said hook being mounted adjacent a front edge of said base and being sized and shaped to engage either of a chisel cut and a perforation in said bags; and said retaining pin being introduced into said hollow core of said roll of film bags and disposed upon said first and second upwardly extending rods with a first bag from said roll extending outwardly beneath said roll and over said snagging hook, thereby providing a dispensing mechanism for said bags.

2. The dispenser for roll mounted film bags, as described in claim 1, wherein said security link is selected from the group comprising:

chain, wire, string, cord or flexible plastic rod.

3. The dispenser for roll mounted film bags, as described in claim 1, wherein said planar base is attached to a fixture for mounting to a horizontal surface.

4. The dispenser for roll mounted film bags, as described in claim 1, wherein said planar base is attached to a fixture for mounting to either of a vertical and angled surface.

5. The dispenser for roll mounted film bags, as described in claim 1, further comprising a bag stream guide, said bag stream guide being attached adjacent said front edge of said planar base and spaced inwardly from said snagging hook.

6. The dispenser for roll mounted film bags, as described in claim 1, wherein said pin has a collar integral with said pin, said collar being disposed adjacent said second end and being sized and shaped to prevent said pin from sliding completely into said core.

* * * * *